United States Patent [19]

Stobb

[11] Patent Number: 4,645,194

[45] Date of Patent: Feb. 24, 1987

[54] METHOD AND APPARATUS FOR CREATING A GAP IN A SHEET STREAM

[75] Inventor: Walter J. Stobb, Pittstown, N.J.

[73] Assignee: Stobb Inc., Clinton, N.J.

[21] Appl. No.: 769,605

[22] Filed: Aug. 26, 1985

[51] Int. Cl.[4] ..... B65H 5/34

[52] U.S. Cl. ..... 271/203; 271/256

[58] Field of Search ..... 271/202, 203, 270, 191, 271/256, 198, 272, 273, 274; 198/457, 461, 577, 579, 631

[56] References Cited

U.S. PATENT DOCUMENTS

| | | | |
|---|---|---|---|
| 4,133,523 | 1/1979 | Berthelot | 271/202 |
| 4,240,856 | 12/1980 | Craemer et al. | 198/792 |
| 4,313,600 | 2/1982 | Mosburger | 271/270 |

*Primary Examiner*—Duane A. Reger

*Attorney, Agent, or Firm*—Arthur J. Hansmann

[57] ABSTRACT

Method and apparatus for creating a gap in a stream of sheets, and also moving the sheets at a uniform rate onto a take-off conveyor. The function is accomplished by diverting a portion of a conveyor to have it move through a longer path than the original path, and thereby have the portion move faster in order to create the gap.

19 Claims, 3 Drawing Figures

METHOD AND APPARATUS FOR CREATING A GAP IN A SHEET STREAM

This invention relates to a method and apparatus for creating a gap in a sheet stream, such as a stream of sheets coming from a printing press and going to a sheet stacker or the like.

BACKGROUND OF THE INVENTION

The graphic arts industry is aware of the concern for handling a stream of sheets moving from a printing press and going to a sheet stacker where the sheets are collected in a stacked form. This is usually accomplished in continuous movement of the sheets. For instance, U.S. Pat. No. 3,781,005 shows a continuous stream of sheets moved on conveyor belts and into a collected stack. In this regard, it is sometimes desirable that the stream be somehow interrupted so that the sheets forming the stack can be clearly segregated from the remainder of the sheets which are still in the stream. Still further, it is sometimes desirable that the sheets formed in a stack are placed therein in an accurate count.

With regard to interrupting or forming a gap in the stream of sheets, U.S. Pat. No. 3,834,288 shows one method of restricting or actually stopping the sheets in their path in the stream, so that the sheets that are upstream from the point of stopping or interruption are actually collected or bunched together so that those sheets in the downstream position can continue on into the stack by themselves. However, in that arrangement, there must be provision for bunching the sheets in the stream, and this frequently involves concern with respect to keeping the sheets in a neatly aligned relationship, since the interruption of the stream flow, or the bunching mentioned, will inherently cause the sheets to get out of alignment and thus create a problem with respect to desired neat stacking.

Accordingly, the present invention provides a method and means for forming a gap in a stream of sheets, and to do so in a manner whereby the sheets are still continuously moved toward the stacker at a desired previous and uniform rate of movement, and there is no bunching of the sheets in the stream in order to form the gap. Still further, the sheets can be accurately counted, with respect to the location of the gap, and thus an accurate number of sheets can pass on to the collected stack of sheets.

Still further, the present invention accomplishes the foregoing, and distinguishes over the prior art, as mentioned, and does so in a facile and inexpensive manner so that the method and apparatus are extremely practical for commercial installation and are highly reliable in forming the accurate count of sheets and in providing a distinct gap in the sheets, without upsetting the continuous flow of sheets to the stack and without getting the sheets out of alignment, all so that they are neatly stacked in the stacker. Thus, a constant stream condition is maintained, rather than the bunched gap condition as commonly used in the prior art.

DETAILED DESCRIPTION OF THE PREFERRED METHOD AND APPARATUS

Figure 1:
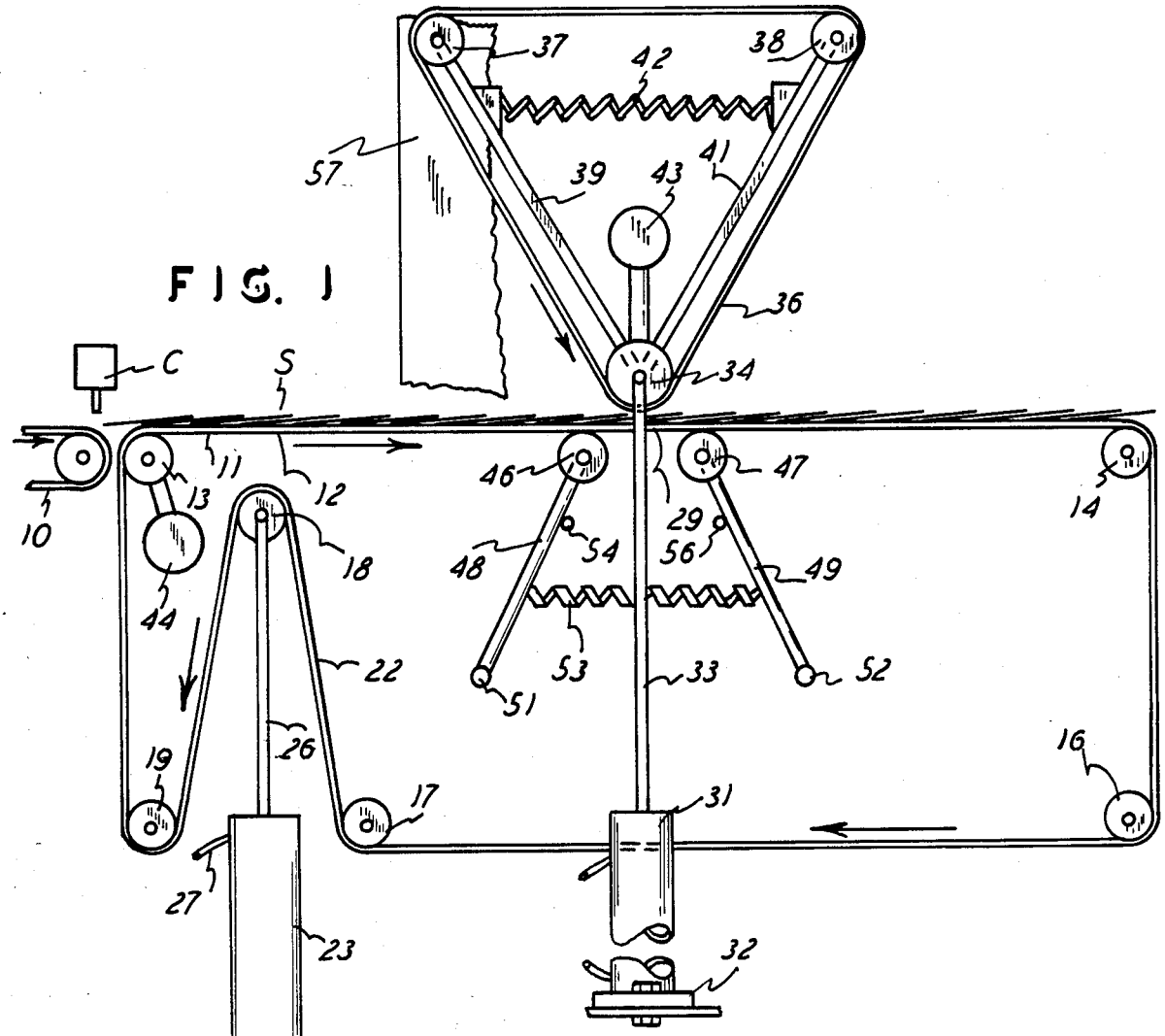
FIG. 1 is a side elevational view of a preferred embodiment of this invention.
Figure 2:
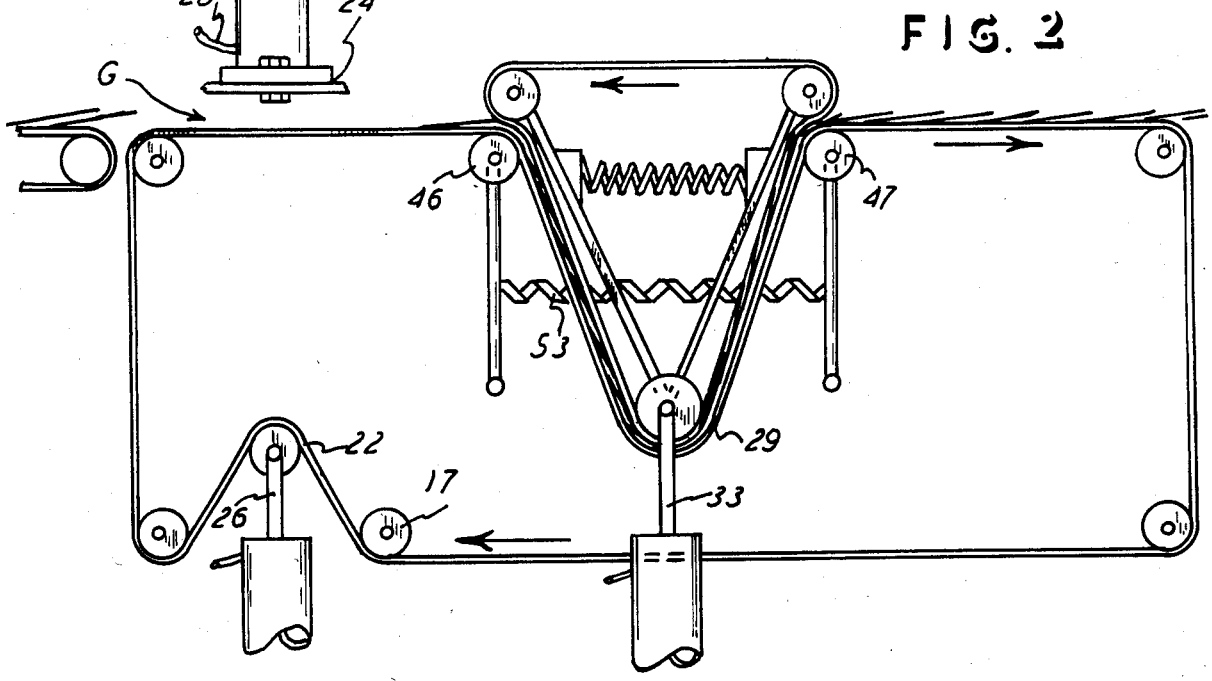
FIG. 2 is a side elevational view similar to FIG. 1, but showing the apparatus and a different position.

In describing the apparatus, the method will be inherently described also. The embodiment of FIGS. 1 and 2 shows an incoming conveyor 10 onto which the sheets are disposed, dropped, or the like, and the sheets are then passed to the endless conveyor or belt 11 which is disposed in line with and adjacent to the conveyor 10. Thus, a stream of sheets "S" is shown disposed on the upper extent 12 of the endless belt 11, and that upper extent is shown to be planar and extends between the support pulley 13 and the support pulley 14. In all instances of describing the conveyors or belts, they move in the direction of the arrows adjacent thereto.

The belt 11 is of course flexible, and it extends around pulleys 16, 17, 18, and 19. Thus the stream "S" moves rightwardly, as viewed in FIG. 1, and would move to a take-off conveyor, such as the conveyor 21 shown in FIG. 3 and which would therefore also be positioned to the right of the pulley 14, as viewed in FIGS. 1 and 2. With that arrangement, the stream "S" moves at a continuous velocity to the right, and the sheets remain in the overlapped or imbricated relationship shown, and they move onto the take-off conveyor 21 at a uniform speed and can be moving off to a stacker or the like.

The purpose of the present invention in both the method and apparatus is to form a gap in the stream "S" but without causing the sheets in the stream to be bunched together, that is, the stream will continue to move at its uniform velocity and onto the conveyor 21. To accomplish that, the conveyor 11 is provided with an offset or spare portion designated 22 and extending between the pulleys 17 and 19, as seen in FIG. 1. The pulley 18 is supported on a diverter, in the form of a fluid cylinder assembly 23 fixedly mounted at 24 and having a piston rod 26 extending upwardly to connect with and support the pulley 18. Accordingly, upon retraction of the rod 26, under suitable controls for the assembly 23, such as through the fluid lines 27 and 28, the rod 26 can be retracted from its FIG. 1 position and moved into the FIG. 2 position, and that diminishes the diverted or spare portion 22, such as shown in FIG. 2.

Simultaneously, the conveyor 11 is diverted at the location designated 29, and it is diverted into the position shown in FIG. 2, and such offset or diversion is accomplished by another fluid cylinder assembly 31 fixedly mounted at 32 and having its rod 33 extend to support a pulley 34 above the stream "S". Thus, upon retracting the rod 33, the amount of original offset in the belt portion 22 is taken up in the portion 29, and thus the stream "S" follows a longer path of travel as it continues to move rightwardly.

A synchronously cooperating conveyor 36 is trained over the pulley 34 and also over two spaced-apart pulleys 37 and 38 which are shown supported on arms 39 and 41, respectively. A spring 42 may be utilized to retain the pulley 37 and 38 spaced apart, and to the triangular formation for the pulleys 34, 37, and 38, as shown. Also, the belt 36 extends endlessly over those three pulleys, and a motor 43 is shown to be in driving relation with the belt 36 which is then driven in sychronization with the speed of the belt 11 which is driven by a motor 44 connected to the belt 11 in a suitable fashion.

Thus, the triangularly shaped belt 36 is lowered onto the stream "S", when desired, and thus presses the stream "S" downwardly onto the belt 11 and holds the stream in the imbricated position on the belt 11, as desired, and as shown in FIG. 2. Two idler type pulleys 46 and 47 are rotatably disposed underneath the belt 11 and aligned with the pulley 34, and these pulleys 46 and 47 are swingable on arms 48 and 49 supported on pivot mountings 51 and 52, for instance. Thus, upon lowering the triangular belt 36 onto the stream "S" the stream is pressed onto the belt 11 and the movable pulleys 46 and 47 are spread apart while they upwardly support the belt 11, such as to the position shown in FIG. 2. Also, a tension spring 53 may be connected between the arms 48 and 49 for holding the pulleys 46 and 47 inwardly toward each other and against stops 54 and 56.

Thus, to achieve the FIG. 2 position, the belt 11 increased its linear speed from its extent between the pulleys 17 and 47. That is, the belt 11 remains taut throughout, since the assemblies 23 and 31 work in unison or synchronization such that the amount of belt released by the assembly 23 is the same as the amount of belt 11 taken up by the assembly 31. However, the linear speed of the belt 11, as mentioned, will increase between the pulleys 17 and 47 in order to accomodate the longer length of extent of the belt 11 on the upper run or portion shown and being described.

By virtue of that arrangement and action, the stream on the belt 11 and between the pulley 47 and pulley 14 will continue to move at its constant velocity to the right and onto the takeoff conveyor 21, all as highly desirable. However, the portion of the belt 11 to the left, as viewed, will have increased its speed, as described, and it will thus create a gap between the conveyor 10, which is a supply conveyor or source, and the conveyor or belt 11, and that is true since the sheets may be either dropped onto the belt 11 or moved by the conveyor 10, both at a uniform speed, but the increaed speed of the belt 11 will cause a gap, such as the gap designated G in FIG. 2. Further, a sheet counter C, of any conventional design, can be disposed at the source of supply and can count the sheets being fed to the conveyor 11. With any suitable and standard connection between the counter C and the controls for the cylinders 23 and 31, the counter can operate the belt 11 at the desired diversion action being described, to create the counted number of sheets to the right of the gap G.

Therefore, the belt 36 forms an engager which presses downwardly on the top of the stream "S" to control the stream when it is in the FIG. 2 orientation, and suitable guides, such as the shown panel 57 are available for guiding the engager 36 in its up-and-down action under the influence of the fluid cylinder assembly 31.

Figure 3:
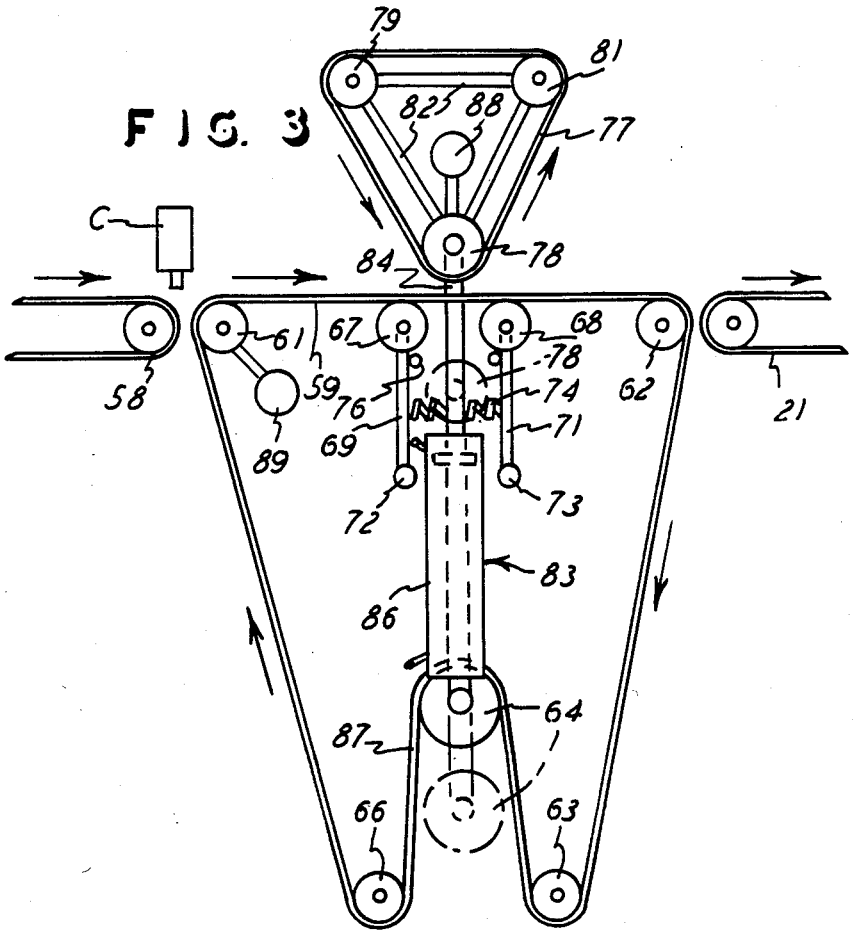
FIG. 3 is a side elevational view of another embodiment of this invention.

FIG. 3 shows different embodiment, and here it will be seen that there is a supply source or conveyor 58 and the stream conveyor 59 extending adjacent thereto and the take-off conveyor 21 on the right. The stream conveyor 59 is suitable supported on pulleys 61, 62, 63, 64, and 66, and again the conveyors or belts shown in FIG. 3 all move in the direction of the arrows adjacent to those belts. Again, the conveyor 59 has its upper planar portion extending between the pulleys 61 and 62, and idler type pulleys 67 and 68 also support the belt 59 and are swingably mounted on arms 69 and 71 mounted on pivots 72 and 73. A tension spring 74 urges the arm 69 and 71 toward each other and against stops, such as the stop 76.

Here again, an engager, in the form of a belt 77 is disposed above the belt 59 and is movable on pulleys 78, 79, and 81 which form the triangular relationship and which may be mounted on arms 82. The pulley 78 is suitably connected to a fluid cylinder assembly 83 which is a double acting assembly with its cylinder fixedly mounted and having its rod 84 extending both above and below the cylinder 86, as shown, and the pulley 78 is mounted on the upper portion of the rod 84. Thus, upon lowering the rod 84, the engager 77 is lowered onto the belt 59, and the stream which would be thereon, as described in connection with FIG. 1, and the engager 77 would force the idler pulleys 67 and 68 apart and thus cause the belt 59 to move faster between the pulleys 63 and 68 when the spare portion designated 87 in the belt 59 is taken up upon lowering of the pulley 64, as being described. Of couse the pulleys 64 and 78 move up-and-down as a unit, since they are both on the same rod 84, and they can move to the dot-dash lines shown for causing the increase in the speed of the belt 59, as being described. Again, that action creates a gap between the source of supply 58 and the belt 59, as desired.

Also, the belt or engager 77 is driven at the same speed as the linear speed of the belt 59, and thus synchronized motors 88 and 89 may be suitably connected with those respective belts for the same speed driving mentioned. Again, the pulley 78 and the like are considered to be a diverter since they engage the upper or initially planar portion of the belt 59 to move it to a longer path of movement while that portion of the belt 59 moves at a greater linear speed, all for creating the gap as described.

While the engager 77 is shown to be a rigid triangle in formation, the belt on the engager 36 can be an elastic type which can contract when it moves between the FIG. 1 and FIG. 2 positions.

What is claimed is:

1. A method for creating a gap in a stream of sheets having a first portion which is adjacent a supply of sheets and a second portion which is downstream from said first portion, comprising the steps of providing said supply of sheets at a supply location, arranging said sheets in an imbricated stream formation and receiving said sheets on a conveyor separated from said supply location and moving said sheets at a uniform rate of speed for supporting and moving the entire stream of sheets at a first speed and along a path of movement away from the supply location, subsequently moving said first portion which is adjacent the supply location at a second speed faster than said first speed to thereby form a gap in the stream formation of the sheets adjacent the supply location while moving said second portion, which is downstream from said first portion, at said first speed for stacking said sheets at said first speed.

2. The method for creating a gap in a stream of sheets as claimed in claim 1, including the step of diverting said first portion and said conveyor off the path of movement and into another path of movement for creating said second speed.

3. The method for creating a gap in a stream of sheets as claimed in claim 1, including the step of passing said second portion of said stream of sheets onto a take-off conveyor in stream-movement communication with the first-mentioned said conveyor, and with said passing of said second portion always being at said first speed.

4. The method for creating a gap in a stream of sheets as claimed in claim 1, including the step of lengthening said conveyor in its extent and direction of stream-supporting movement away from the supply location and where said conveyor was supporting said stream, for creating said second speed.

5. A method for stacking sheets at a location by creating a gap in a stream of sheets moving in a direction between a supply and said stacking location, including the steps of moving said stream of sheets at a first uniform speed adjacent both said supply and said stacking location, receiving said sheets from said supply on a conveyor spaced from said supply, and increasing the speed of said stream of sheets in said direction, at the location of said conveyor adjacent said supply, to a speed faster than said first uniform speed to thereby create a gap in said stream of sheets at said location adjacent said supply, and lengthening said conveyor at its said location adjacent said supply by moving said conveyor at its said location adjacent said supply in said direction for creating said faster speed of said stream of sheets.

6. Apparatus for creating a gap in a stream of sheets, comprising a first conveyor providing a source of supply of sheets at a first speed, a second conveyor adjacent said first conveyor in sheet-flow communication therewith and being operable in a direction away from said first conveyor for receiving and moving sheets in an imbricated stream relation and at said first speed of movement, said second conveyor having a separately movable first portion adjacent said first conveyor and is a flexible belt and extends endlessly and includes a spare portion downstream from said first portion and along the length of said belt, means for moving said first portion of said second conveyor at a speed faster than said first speed in the direction away from said first conveyor to thereby form a gap in the stream formation of the sheets at the location adjacent said source of supply, and said means consists of a diverter connectable with said belt and being movable for deflecting said belt to take up said spare portion therein and to thereby create the faster speed.

7. The apparatus for creating a gap in a stream of sheets as claimed in claim 6, wherein said diverter is a fluid cylinder assembly extendable and contractable for controlling the spare portion in said belt.

8. The apparatus for creating a gap in a stream of sheets as claimed in claim 6, including a movable stream engager disposed adjacent said belt and being connected with said diverter for movement onto the stream of sheets while said belt is being deflected, and thereby confine the stream of sheets between said belt and said engager.

9. The apparatus for creating a gap in a stream of sheets as claimed in claim 6, including a take-off conveyor in stream-flow communication with said belt and movable at said first speed for receiving the stream from said belt, said spare portion extending from said first portion and back to the source fo supply.

10. The apparatus for creating a gap in a stream of sheets as claimed in claim 8, wherein said diverter is a fluid cylinder assembly extendable and contractable for controlling said spare portion in said belt.

11. The apparatus for creating a gap in a stream of sheets as claimed in claim 8, including a movable stream engager disposed adjacent said belt and being connected with said diverter for movement onto the stream of sheets while said belt is being deflected, and thereby confine the stream of sheets between said belt and said engager.

12. Apparatus for creating a gap in a stream of sheets, comprising a source of supply of sheets, a conveyor adjacent said source of supply and being movable in a direction away from said source of supply for receiving and moving sheets in an imbricated stream relation and at a first speed of movement, and means for moving said conveyor at a speed faster than the first speed in the direction away from said source of supply to thereby form a gap in the stream formation of the sheets at the location adjacent said source of supply, said conveyor is a flexible belt and extends endlessly and includes a spare portion along its length, and said means consists of a diverter connectable with said belt and being movable for deflecting said belt to take up the spare portion therein and to thereby create the faster speed.

13. The apparatus for creating a gap in a stream of sheets as claimed in claim 12, wherein said diverter is a fluid cylinder assembly extendable and contractable for controlling the spare portion in said belt.

14. The apparatus for creating a gap in a stream of sheets as claimed in claim 12, including a movable stream engager disposed adjacent said belt and being connected with said diverter for movement onto the stream of sheets while said belt is being deflected, and thereby confine the stream of sheets between said belt and said engager.

15. The apparatus for creating a gap in a stream of sheets as claimed in claim 12, wherein said belt has a first portion in its extent away from the source of supply, and including a take-off conveyor in stream-flow communication with said first portion of said belt for receiving the stream therefrom, said belt having a spare portion in the extent of said belt extending from said first portion and back to the source of supply, and a diverter connectable with said first portion for deflecting said first portion to take up said spare portion and thereby create the faster speed.

16. The apparatus for creating a gap in a stream of sheets as claimed in claim 15, wherein said diverter is a fluid cylinder assembly extendable and contractable for controlling the spare portion in said belt.

17. The apparatus for creating a gap in a stream of sheets as claimed in claim 15, including a movable stream engager disposed adjacent said belt and being connected with said diverter for movement onto the stream of sheets while said belt is being deflected, and thereby confine the stream of sheets between said belt and said engager.

18. A method for creating a gap in a stream of sheets, comprising the steps of providing a supply of sheets at a supply location, moving the sheets at a uniform rate and into an imbricated relation and onto a moving flexible belt for supporting and moving the stream of sheets at a first speed and along a path of movement away from the supply location, subsequently moving the stream and belt which are adjacent the supply location at a second speed faster than said first speed to thereby form a gap in the stream formation of the sheets adjacent the supply location, and diverting the stream and belt off the path movement and into another path of movement for effecting the aforesaid faster speed.

19. A method for creating a gap in a stream of sheets, comprising the steps of providing a supply of sheets at a supply location, moving the sheets at a uniform rate and into an imbricated relation and onto a moving flexible belt for supporting and moving the stream of sheets at a first speed and along a path of movement away from the supply location, subsequently moving the stream and belt which are adjacent the supply location at a second speed faster than said first speed to thereby form a gap in the stream formation of the sheets adjacent the supply location, deflecting the belt in its extent of movement away from the supply location for creating the second speed.

* * * * *